US011499687B1

(12) United States Patent
Rashidi Doust

(10) Patent No.: US 11,499,687 B1
(45) Date of Patent: Nov. 15, 2022

(54) TROFFER LIGHT FIXTURE WITH COVER CONTAINING LENSES

(71) Applicant: ELITE LIGHTING, Commerce, CA (US)

(72) Inventor: Hamid Rashidi Doust, Beverly Hills, CA (US)

(73) Assignee: Elite Lighting, Commerce, CA (US)

( * ) Notice: Subject to any disclaimer, the term of this patent is extended or adjusted under 35 U.S.C. 154(b) by 0 days.

(21) Appl. No.: 17/567,808

(22) Filed: Jan. 3, 2022

Related U.S. Application Data

(60) Provisional application No. 63/287,526, filed on Dec. 8, 2021.

(51) Int. Cl.

| | |
|---|---|
| ***F21S 8/02*** | (2006.01) |
| ***F21V 5/00*** | (2018.01) |
| ***F21V 5/04*** | (2006.01) |
| ***F21V 7/05*** | (2006.01) |
| *F21Y 105/10* | (2016.01) |

(52) U.S. Cl.
CPC ..... *F21S 8/026* (2013.01); *F21V 5/008* (2013.01); *F21V 5/04* (2013.01); *F21V 7/05* (2013.01); *F21Y 2105/10* (2016.08)

(58) Field of Classification Search
CPC .. F21S 8/026; F21S 8/04; F21V 7/005; F21Y 2105/10
See application file for complete search history.

(56) References Cited

U.S. PATENT DOCUMENTS

| | | | | |
|---|---|---|---|---|
| 8,087,807 | B2 * | 1/2012 | Liu | F21V 29/75 362/373 |
| 8,789,966 | B2 * | 7/2014 | McCanless | F21V 17/164 362/373 |
| 10,012,375 | B1 * | 7/2018 | Salessi | F21V 31/005 |
| 10,415,799 | B1 * | 9/2019 | Grove | F21V 3/00 |
| 10,648,643 | B2 * | 5/2020 | Edmond | F21V 7/005 |
| 2009/0196023 | A1 * | 8/2009 | Heiking | F21S 8/026 362/240 |
| 2009/0196024 | A1 * | 8/2009 | Heiking | F21S 8/026 362/150 |
| 2010/0277105 | A1 * | 11/2010 | Oyama | A61N 5/0618 315/312 |
| 2012/0092869 | A1 * | 4/2012 | Thomas | F21S 8/04 362/249.02 |
| 2012/0293994 | A1 * | 11/2012 | McMurray | F21V 19/003 362/249.02 |
| 2014/0168961 | A1 * | 6/2014 | Dubord | F21V 21/14 362/225 |
| 2015/0029715 | A1 * | 1/2015 | Yun | F21S 8/04 362/235 |
| 2019/0170341 | A1 * | 6/2019 | Lax | F21V 29/763 |
| 2021/0010670 | A1 * | 1/2021 | van Delden | F21V 5/02 |
| 2021/0341134 | A1 * | 11/2021 | May | F21S 2/00 |

* cited by examiner

*Primary Examiner* — Rajarshi Chakraborty
*Assistant Examiner* — Michael Chiang
(74) *Attorney, Agent, or Firm* — Payam Moradian

(57) ABSTRACT

Provided is a light fixture comprising: a) a housing; b) a cover for the housing; d) one or more lenses configured to be attached to the cover; and d) a plurality of LED light sources placed inside of the housing to provide a substantially uniform light through the one or more lenses.

15 Claims, 16 Drawing Sheets

TROFFER LIGHT FIXTURE WITH COVER CONTAINING LENSES

CROSS-REFERENCE

The present application claims the benefit of U.S. provisional patent application 63/287,526, filed on Dec. 8, 2021, which is incorporated by reference in its entirety.

BACKGROUND SECTION OF THE INVENTION

Troffer light fixture is a rectangular light fixture that fits into a modular dropped ceiling grid. The problem with troffer light fixtures is that they are too bulky and do not provide a uniform and adequate illumination. There is a need in the art for a troffer light fixture that addresses these issues.

SUMMARY SECTION OF THE INVENTION

Provided is a light fixture comprising: a) a housing; b) a cover for the housing; one or more lenses configured to be attached to the cover; and d) a plurality of LED light sources placed inside of the housing to provide a substantially uniform light through the one or more lenses. The height of the troffer light fixture is less than three inches, such as between two and three inches, such as between 2.0 and 2.5 inches. An optic can be placed on the LED light sources. The fixture can have 50 to 150 optics, with each optic placed on top of the one or more LED light sources. The fixture can have 4 to 8 rows of optics. The fixture can have about 75 to about 125 optics. The fixture can have about 85 light sources to 105 sources. The fixture can have a reflective paper on the housing around the optics. At least 50% or at least 80% of the optics can be completely covered all around by the reflective paper. The fixture can have three flat lenses. Two of the lenses are positioned on the sides and orient inwardly on their long side. The fixture can have separate sources of light and an optics housing with a plurality of optics placed over the separate sources of light. In one embodiment, the light from the plurality of the separate light sources and light from the plurality of LED light sources do not mix with each other inside of the housing. The separate light sources are also LED lights. The cover can have a portion that creates a separation in the fixture between the separate light sources and the LED light sources, minimizing the mixture of light inside of the housing.

Alight fixture comprising: a) a housing; b) a cover for the housing; c) three lenses configured to be attached to the cover; d) LED light sources attached to the housing; e) optics in a number of 50 to 150 covering the LED light sources, the optics forming 4 to 8 parallel rows; and f) a reflective paper attached to the housing covering all sides of at least 50% of the optics. The three lenses can be flat. Two of the lenses can be positioned on the sides and orient inwardly on their long side.

Provided is a light fixture comprising: a) a housing; b) a cover for the housing; c) two lenses configured to be attached to the cover; d) LED light sources attached to the housing in a configuration to allow light to pass through the lenses; e) a first optics covering the LED light sources; f) a separate source of light; and g) an optics housing with a plurality of second optics placed over the separate source of light. The optics housing can be rectangular and have a plurality of openings for placing the second optics. The lenses lack a dark spot as visible to the naked eye. The cover can have a member that moves upward and does not, allow light from the different light sources to mix.

DETAILED DESCRIPTION OF THE INVENTION

Figure 1:
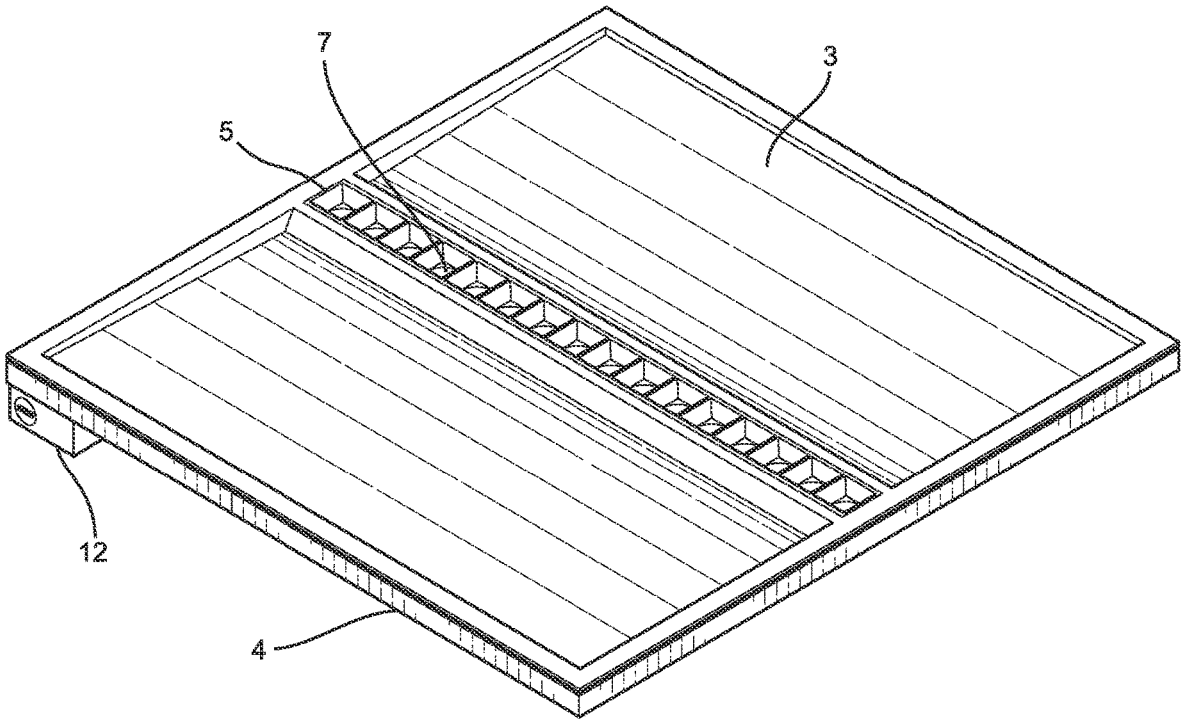
FIG. 1 illustrates a perspective view of a troffer fixture with an optics housing.
Figure 2:
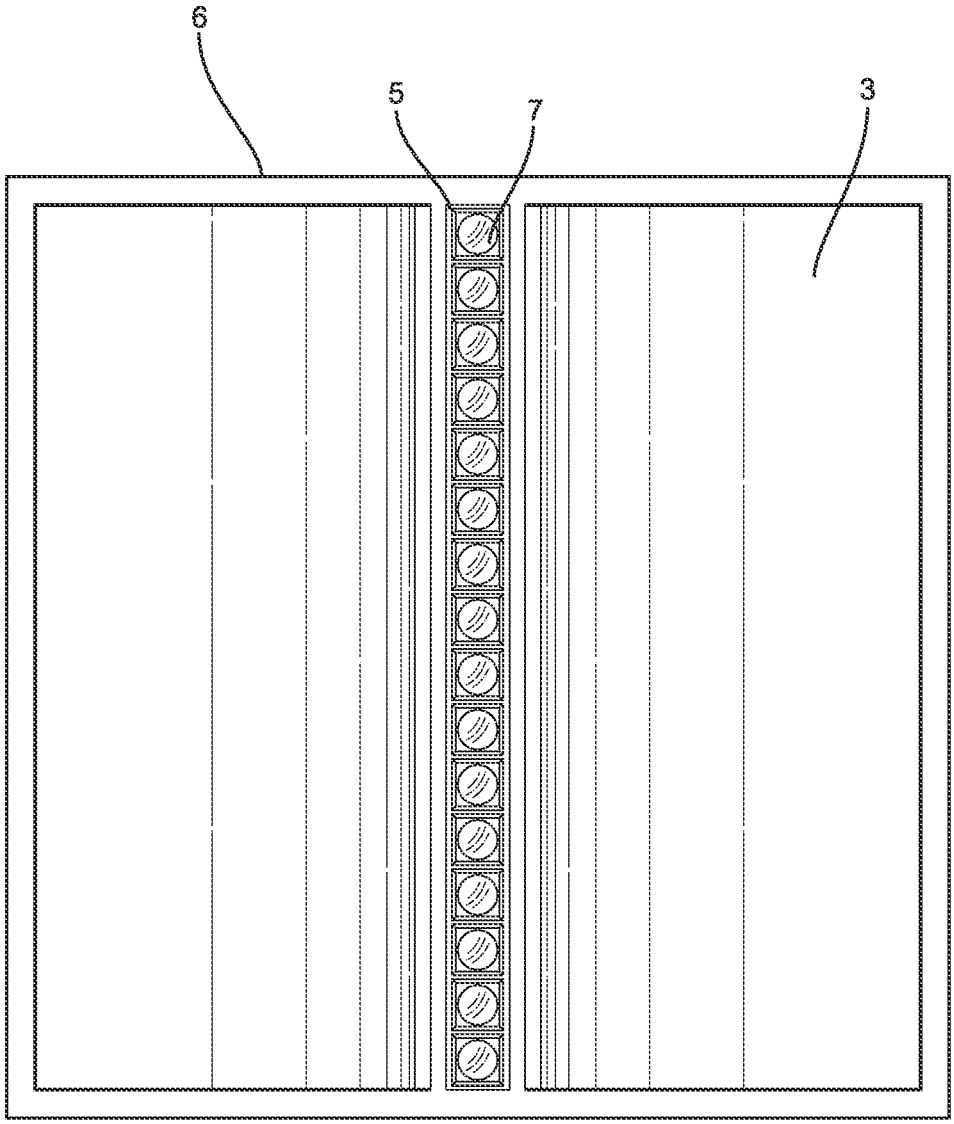
FIG. 2 illustrates a bottom view of a troffer fixture with an optics housing.
Figure 3:
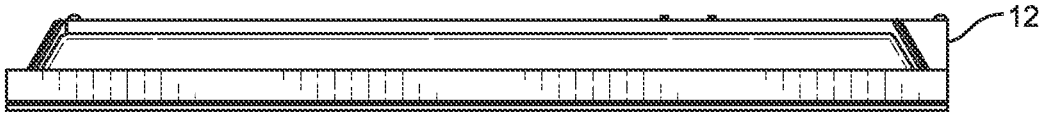
FIG. 3 illustrates a side view of a troffer fixture.
Figure 4:
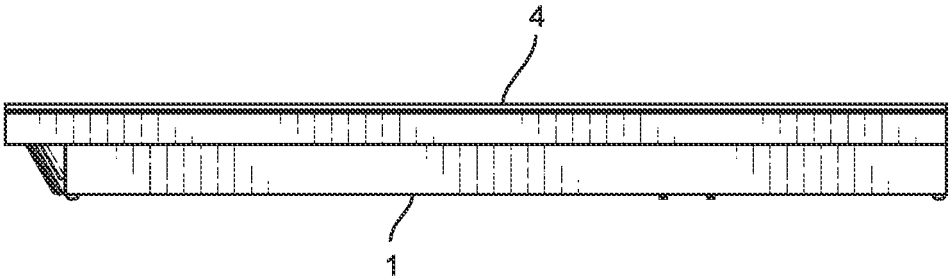
FIG. 4 illustrates a side view of a troffer fixture.
Figure 5:
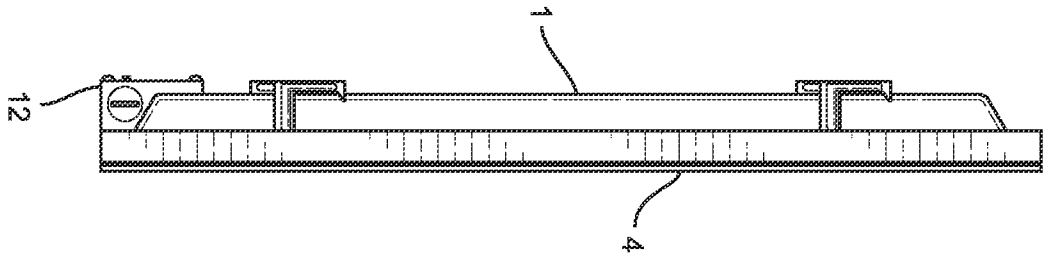
FIG. 5 illustrates a side view of a troffer fixture.
Figure 6:
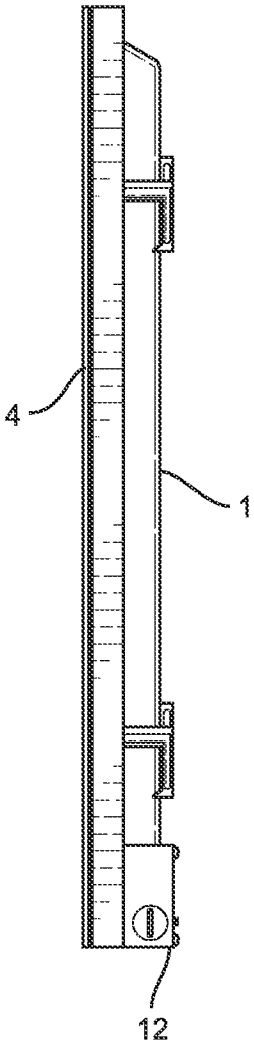
FIG. 6 illustrates a side view of a troffer fixture.
Figure 7:
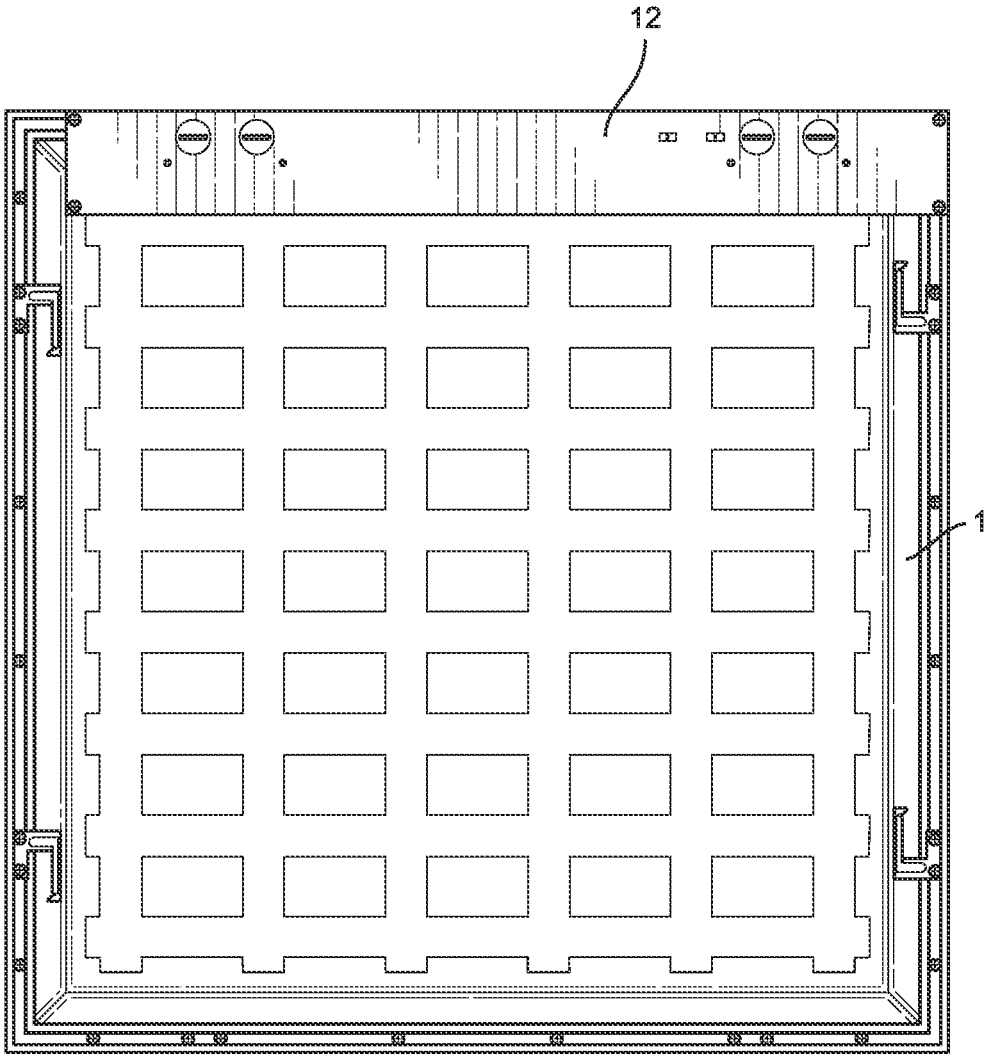
FIG. 7 illustrates a rear view of a troffer fixture.
Figure 8:
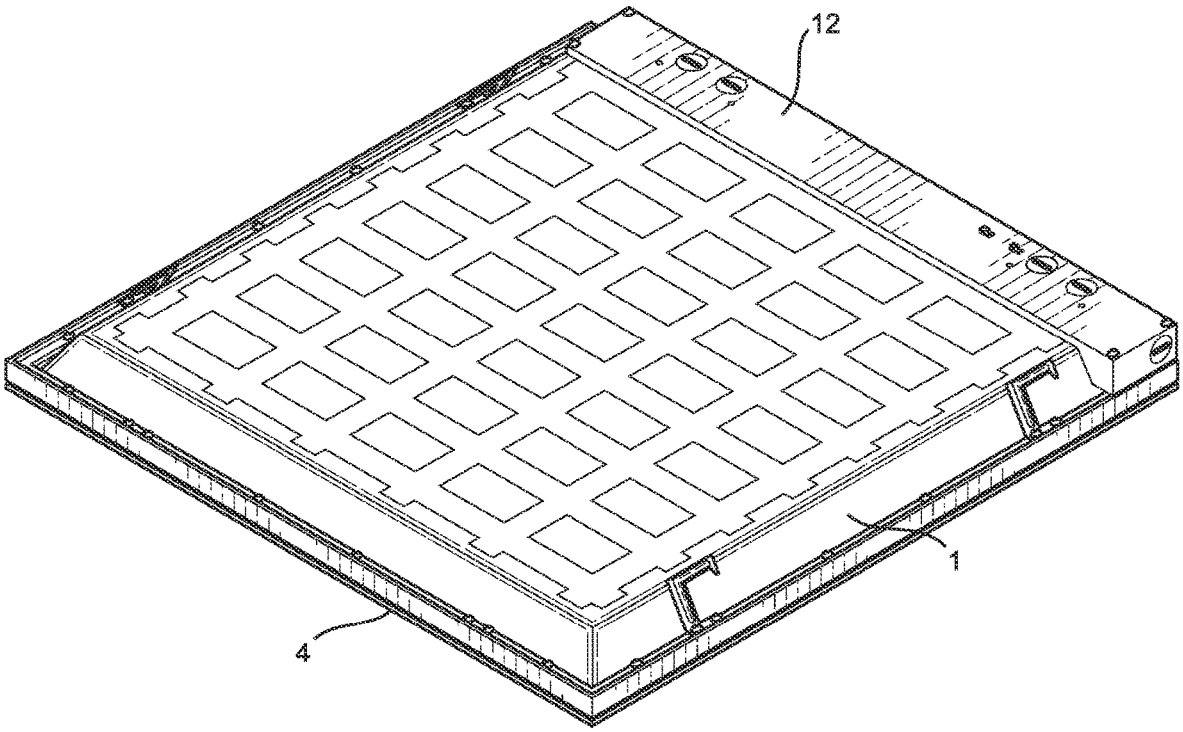
FIG. 8 illustrates a top perspective view of a troffer fixture.

Provided is a thin troffer light fixture that produces uniform light with minimal glare. The light fixture can have a depth of less than about three inches, such as one to three inches. The troffer light fixture includes a housing 1, a front cover 4, and light sources 2. The housing 1 can be made of a metal and comprise the top portion of the fixture. A front cover 4 is placed in front of the housing.

As illustrated, cover 4 or cover 6 can be attached to the housing 1. Cover 4 as illustrated has three rectangularly shaped lenses and/or diffusers 3. All three lenses 3, 13 can be flat. The lenses 3 on the sides can be oriented inwardly on their long sides, with an orientation of 1 to 10 degrees. The lens 13 on the middle can be straight and set in between the other two lenses 3 on the sides. The lenses 3, 13 can be made from a transparent or translucent material.

Cover 6 can also be used. Cover 6 is configured to receive two lenses 3 on the sides and an optics housing 5 in the middle. The lenses 3 on the sides and the middle lens 13 can be made form a transparent or translucent materials. The lenses 3 can be flat and rectangularly shaped, and have an inwardly orientation of 1 to 10 degrees.

Cover 6 can be configured to receive an optics housing 5. The optics housing 5 can have an, elongated body with individual compartments for receiving optics 7. The optics housing 5 as illustrated can receive sixteen optics. The optics housing 5 can have individual spaces for receiving the optics 7. Each of the optics 7 can be a circular lens. The optics 7 can be micro or macro-optics.

Figures illustrate a close-up of the optics housing 5 and cover 6. The LED light sources 2 are placed on the housing 1 below the optics 7. One or a plurality of LED light, sources 2 as illustrated are placed directly below each lens 3. As illustrated four LED light sources 2 are placed under each optic 7.

The cover 6 can extend upward around the cavity configured to receive the lens housing and create a chamber for the lenses 3. Housing 1 can have members 8 on each side of the opening configured to receive the optics housing 5. The members 8 separate the light from LED sources 2 that are not placed under the optics housing 5, and minimize mixing of light from the different chambers.

LED light sources 2 are placed inside of housing 1, facing downwardly. The LED light sources 2 can be arranged in a plurality of parallel configurations. There can be a plurality of LED boards with LED light sources 2 placed in a parallel configuration to each other.

The fixture can have LED light sources 2 placed in a substantially uniform layout to produce a substantially uniform light throughout the fixture. When a user looks at the fixture, all the lenses 3 look to be lit substantially the same and lack dark spots. The ratio between minimum and maximum footcandela can be more than 0.095 (per square feet). This is the ratio of illumination.

The fixture can have about 3 to about 9 rows (as defined by the optics placed on the LED light source(s)) of LED light sources 2, which can be placed in a parallel configuration. The distance between each LED light sources 2 in a row can be less (such as 60% to 20% less) than the distance between each LED light source 2 in the parallel rows. The end of each row can have two LED light sources 2 that are placed immediately next to each other, with a distance of 1 to 5 mm from the closest ends to each other. The other LED light sources 2 in the row can be distanced further from each other, such as 1 cm to 7 cm from the closest ends.

The fixture can have about 50 to 150 light sources 2 (as defined by an optic on the inside of the housing, excluding the optics housing), such as about 75 to about 125 light sources 2, such as about 85 light sources to 105 sources. As illustrated, there are 96 light sources 2 in six rows. All the rows can be electronically connected to the power source with a perpendicularly placed conductor 9.

The LED light sources 2 can have an optic 10, such as a transparent circular/spherical optic as illustrated. A paper 11, such as highly reflective and/or glassy paper can be placed on the LED boards so that only the LED light source 2 portion is visible. Other than the light sources 2, the entirety of the housing can be covered with the paper 11 to increase reflection of light and minimize any light distortion.

The reflective paper 11 can be placed all around the spherical optics 10. A few of the spherical lenses may not be entirely surrounded by the paper 11 depending on configuration of the LED light sources 2. In one embodiment, more than 80%, or more than 90%, or more than 95% of the optics 10 have a paper all around them. In one embodiment, at least 90% to 100%, or 100% of the optics 10 have a paper 11 at least around one portion of the optic 10.

Housing 1 can have a space on the outside for placement of a ballast housing 12. The ballast housing 12 can be placed in a depression on the side of the housing 1, to minimize height of the fixture.

The fixture has minimal glare, with the glare having a value of glare of 19 or less (UGR). The lenses can have the same light intensity throughout. In one embodiment, the glare is between 13 to 19 UGR, such as about 15-17 or 16 UGR, or less than 16, or less than 15.

The light fixture can have color changing LEDs and a switch to allow a user to configure the desired color. The color of the light sources can be: Soft White (2700K-3000K), Bright White/Cool White (3500K-4100K), and Daylight (5000K-6500K). Other colors can also be used.

Figure 14:
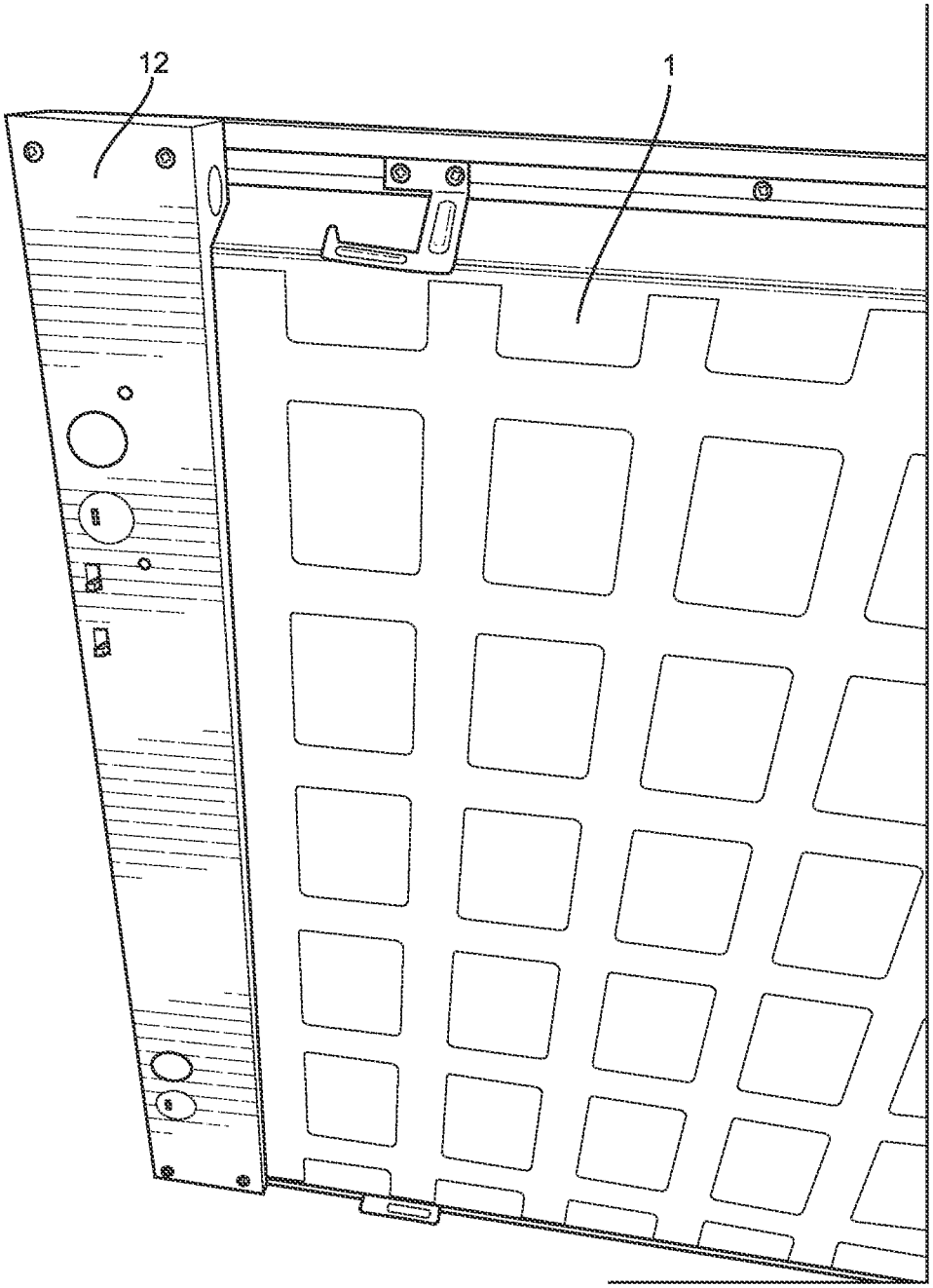
FIG. 14 illustrates the top of the troffer fixture, with a ballast housing on the side.

A ballast housing 12 and a ballast can be placed on the top-side of the fixture as illustrated in FIG. 14, in an indentation in the housing 1.

Figure 9:
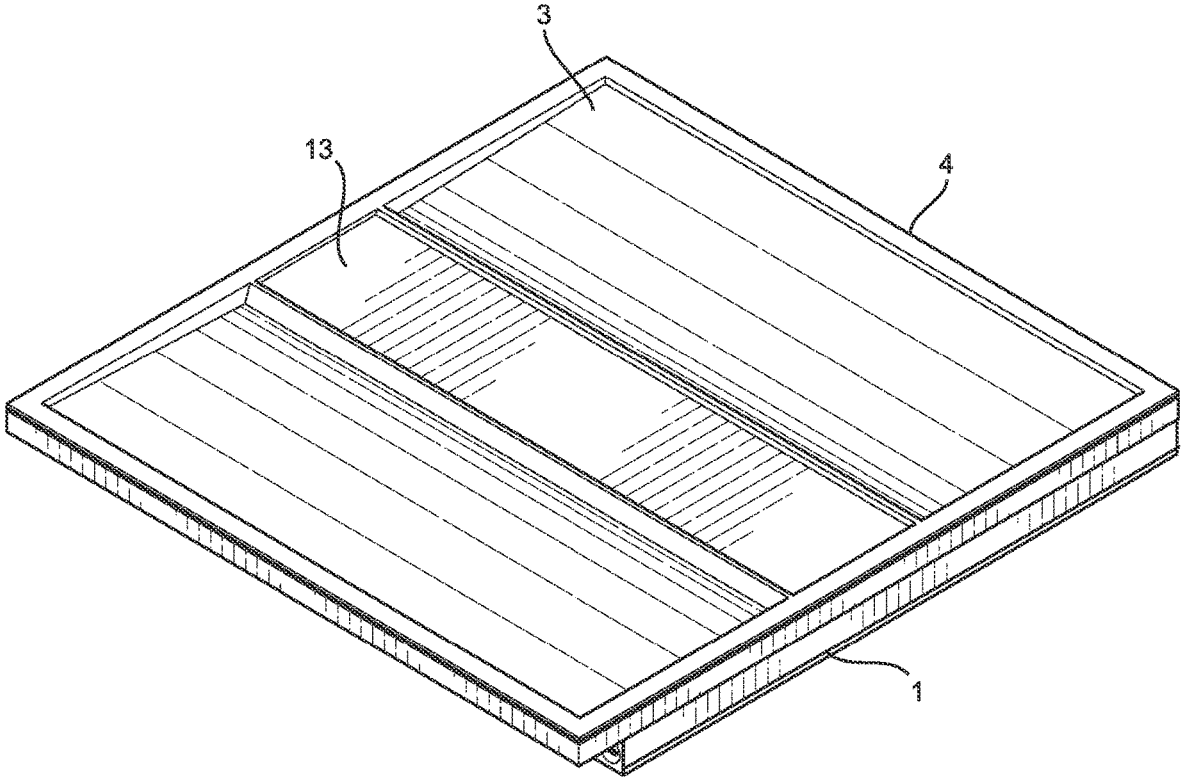
FIG. 9 illustrates a perspective view of a troffer fixture with three lenses.
Figure 10:
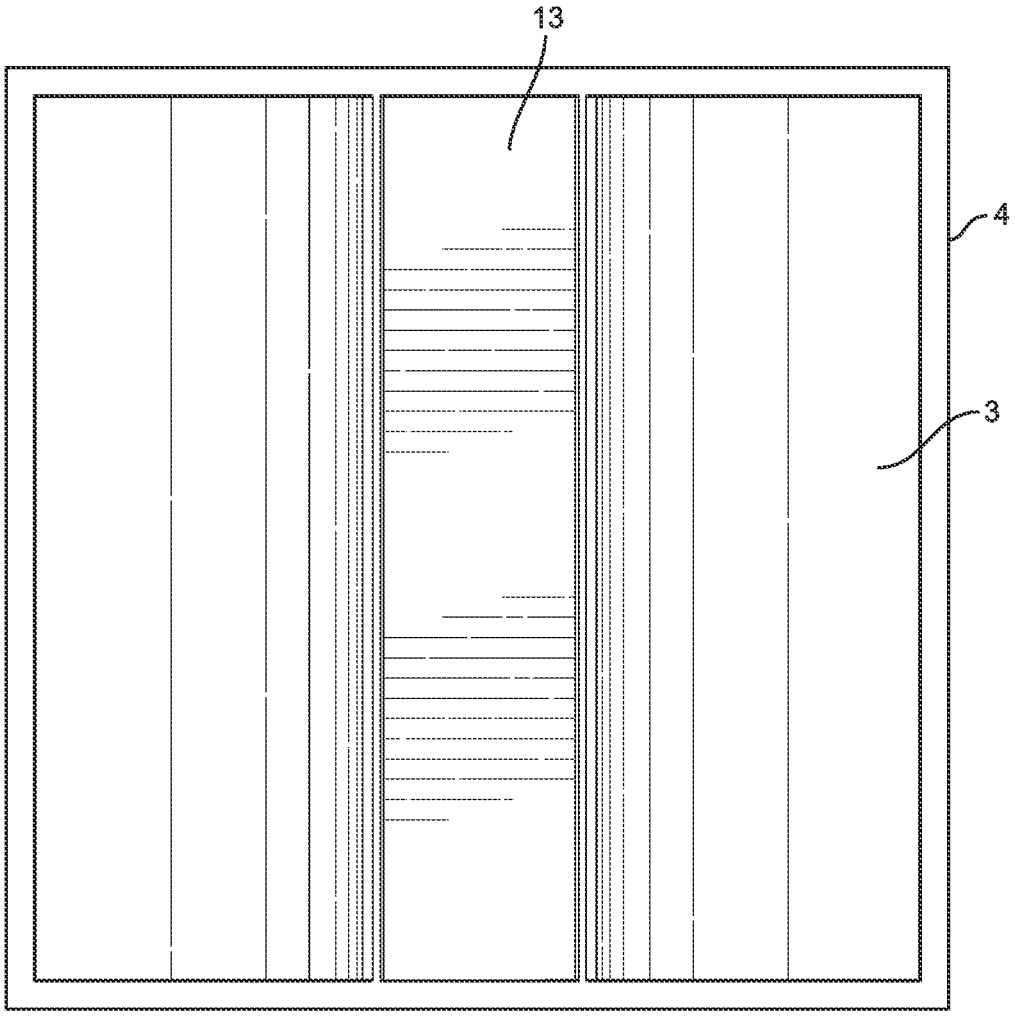
FIG. 10 illustrates a bottom view of a troffer fixture with three lenses.
Figure 11:
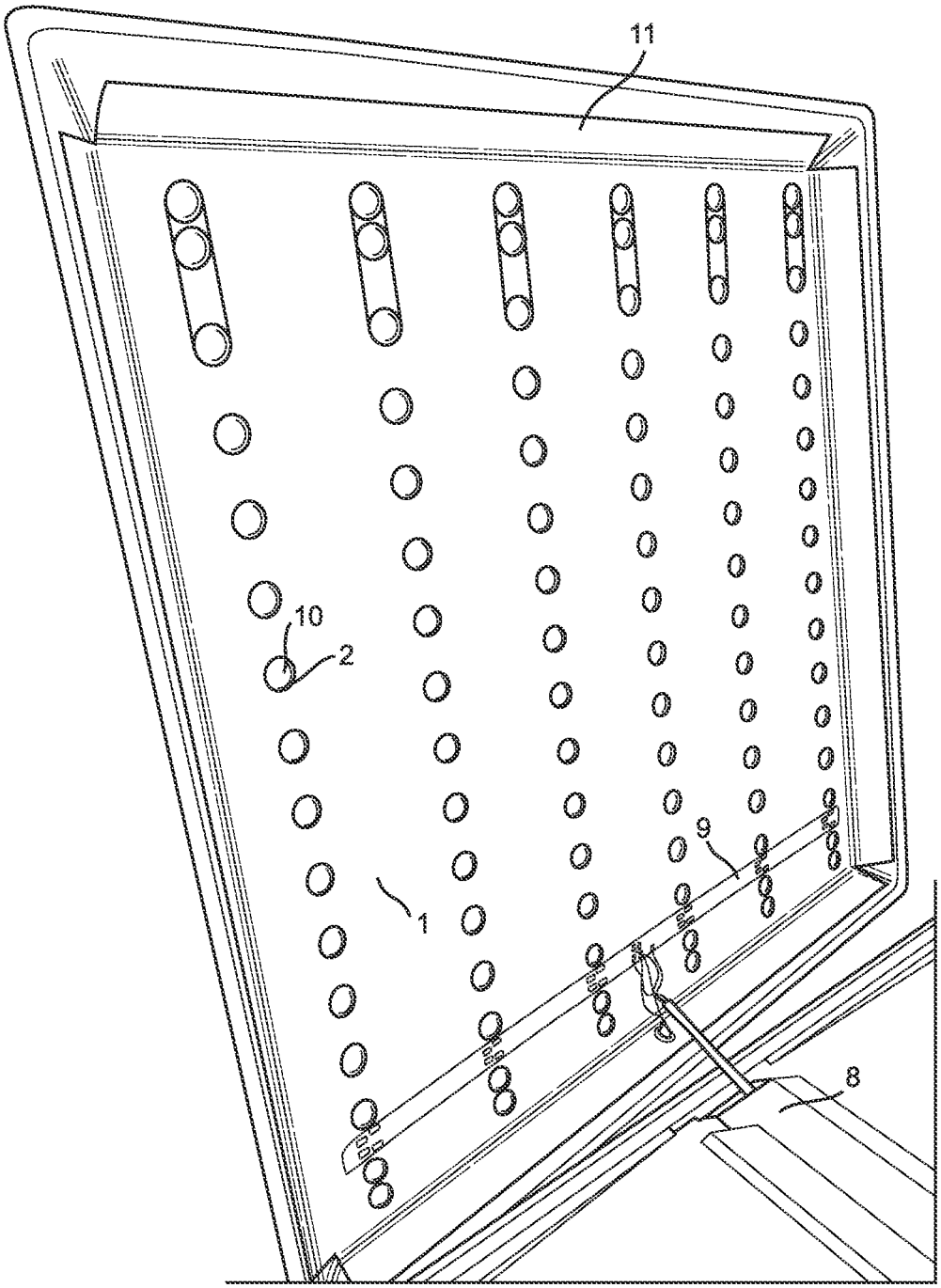
FIG. 11 illustrates a bottom view of a troffer fixture housing with rows of LED light sources covered by optics.
Figure 12:
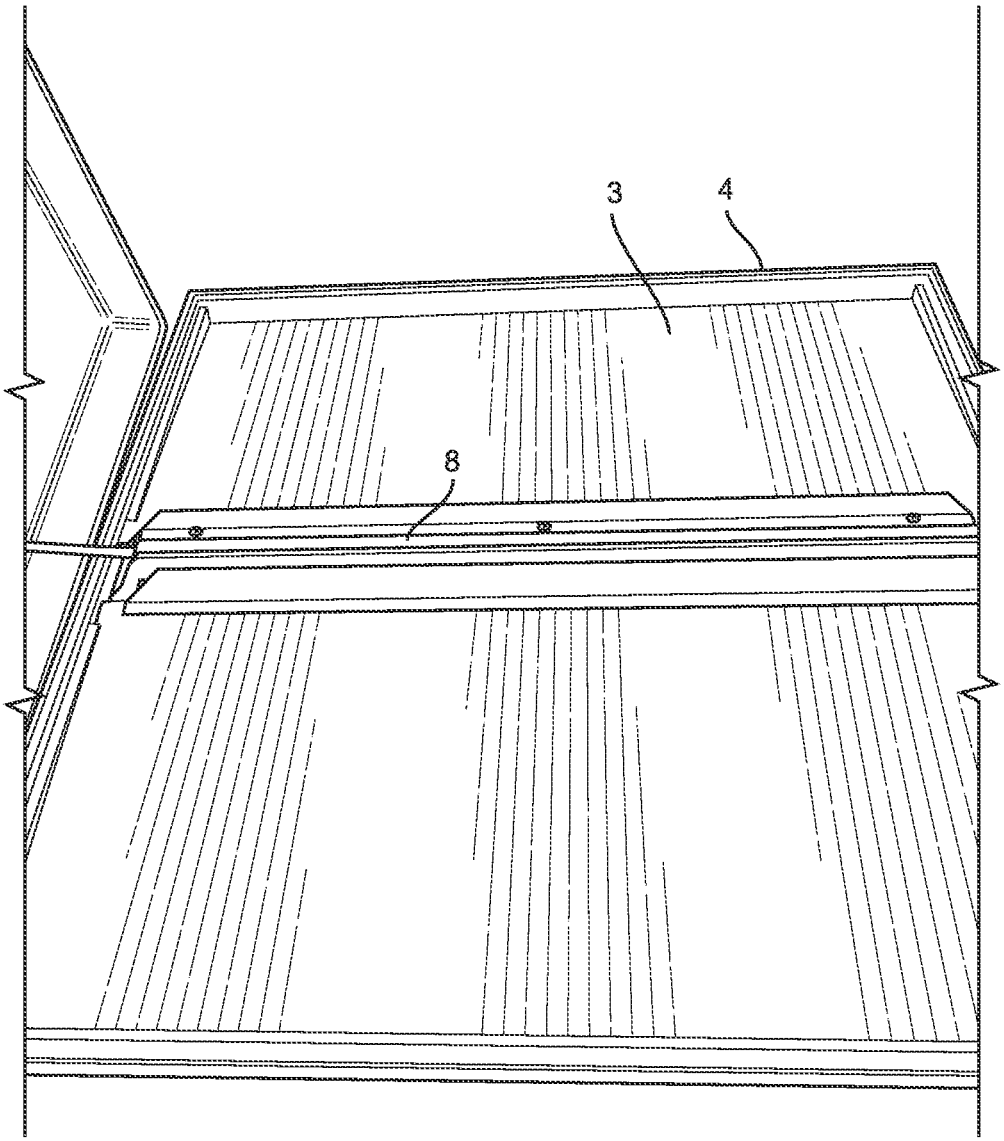
FIG. 12 illustrates the inside of the cover with the optics in the middle and lenses on the sides.
Figure 13:
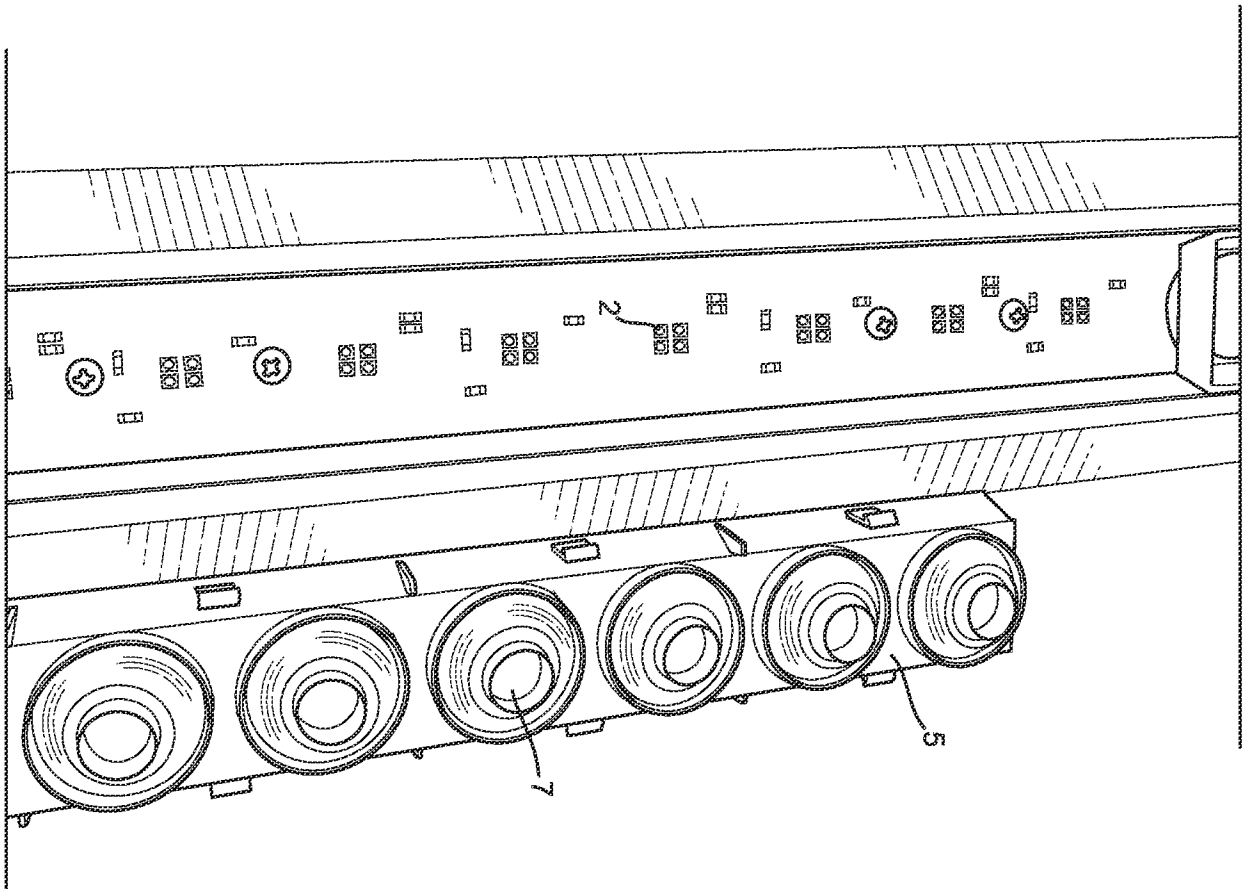
FIG. 13 illustrates light sources and optics that are placed over the light sources.
Figure 15:
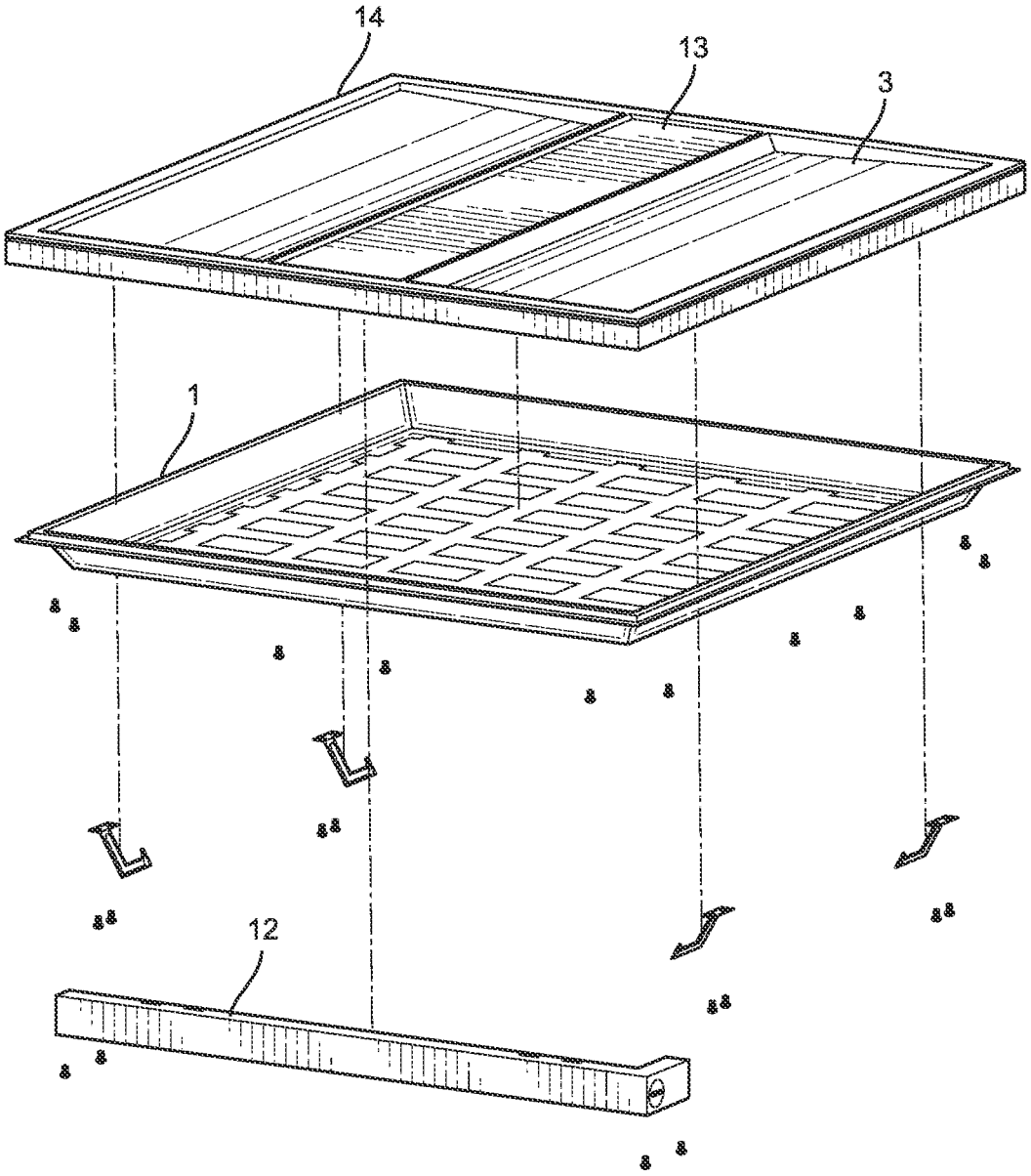
FIG. 15 is an exploded view of the light fixture with the three lenses.
Figure 16:
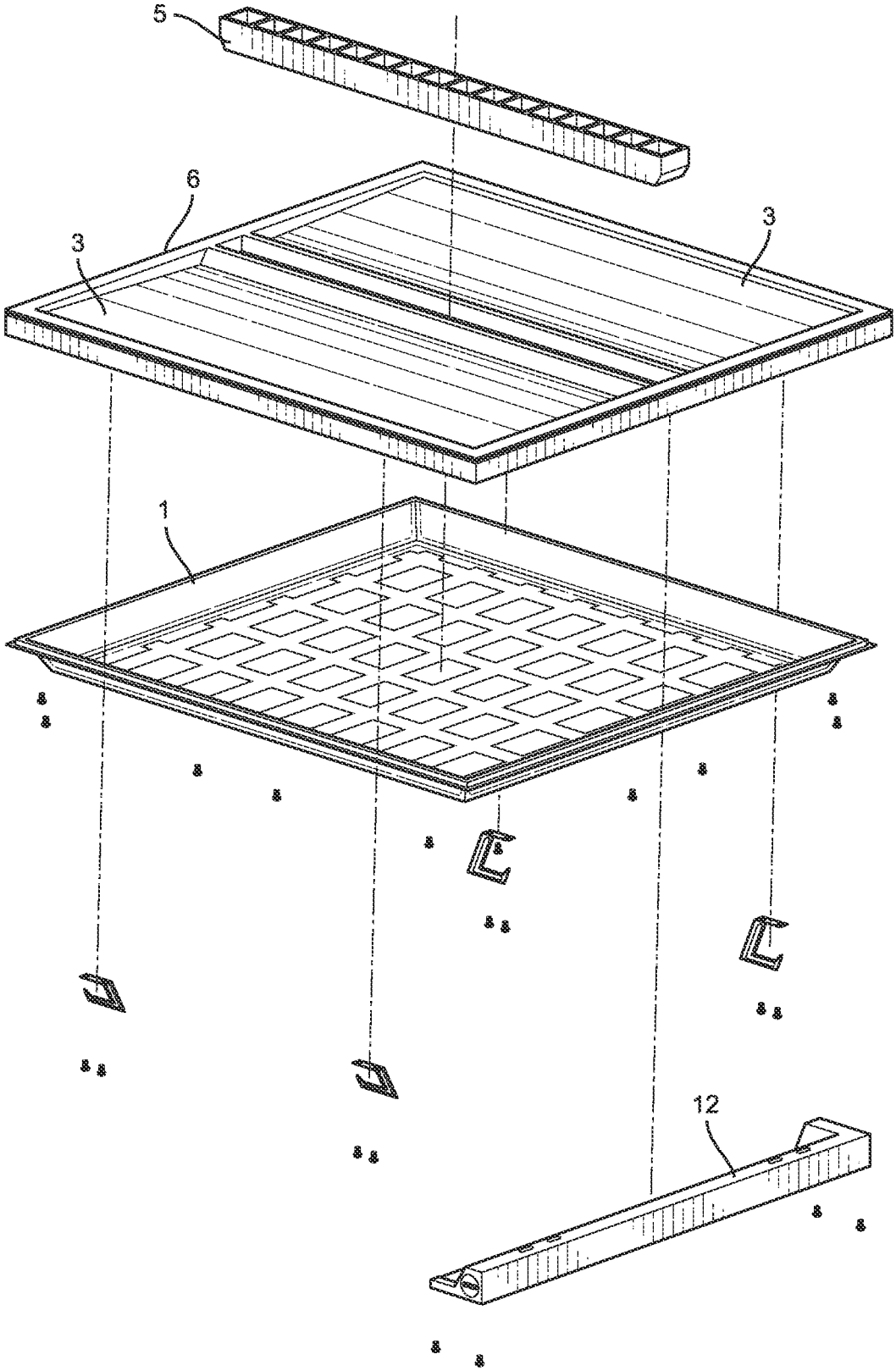
FIG. 16 is an exploded view of the light fixture with the optics placed in the middle.

FIGS. 1 and 16 illustrate a first embodiment of the fixture where an optics housing is placed in between the two lenses on the sides. FIGS. 9 and 15 illustrate a second embodiment where three lenses are places in bottom of the fixture. FIG. 14 illustrates placement of a ballast housing in the top of the fixture. The same LED light sources 2 in FIG. 13 can be used in all embodiments of the present invention. Optics 10 can cover 1, 2, 3 or 4 LED light sources 2.

REFERENCES

1 Housing
2 LED Light Source
3 Lens
4 Cover
5 Optics Housing
6 Cover
7 Optics
8 Member
9 Conductor
10 Optics
11 Paper
12 Ballast Housing
13 Central Lens What, is claimed is:

1. A light fixture comprising:

a) a housing;

b) a cover for the housing;

c) three lenses configured to be attached to the cover wherein the three lenses are flat, and two of the lenses are positioned on the sides of the bottom of the fixture and facing downwardly and are oriented inwardly on their long side towards the housing;

d) LED light sources attached to the housing;

e) optics in a number of 50 to 150 covering the LED light sources, the optics forming 4 to 8 parallel rows; and f) a reflective paper attached to the housing covering all sides of at least 50% of the optics.

2. The light fixture of claim 1, wherein the light fixture is a troffer light fixture and a height of the troffer light fixture is less than three inches.

3. The light fixture of claim 1, further comprising a plurality of optics placed on the first light sources.

4. The light fixture of claim 1, wherein the fixture has about 75 to about 125 optics.

5. The light fixture of claim 1, wherein the fixture has a reflective paper on the housing around the optics.

6. The light fixture of claim 5, wherein at least 80% of the round optics are completely surrounded by the reflective paper.

7. The light fixture of claim 1, wherein a ratio between minimum and maximum footcandela of the fixture is more than 0.095.

8. The light fixture of claim 1, further comprising a second LED sources of light and an optics housing with a plurality of round optics placed over the second sources of light.

9. The light fixture of claim 8, wherein the light, from the plurality of the second LED light sources and light from the plurality of first LED light sources do not mix with each other inside of the housing.

10. The light fixture of claim 9, wherein the cover has an integrated portion that creates a separation in the fixture between the second light sources and the first light sources, minimizing the mixture of light inside of the housing.

11. A light fixture comprising:

a) a housing;

b) a cover for the housing;

c) two lenses configured to be attached to the cover wherein the two lenses are flat, and two of the lenses are positioned on the sides of the bottom of the fixture and facing downwardly and are oriented inwardly on their long side towards the housing;

d) first LED light sources attached to the housing in a configuration to allow light to pass through the lenses;

e) a plurality of first round optics covering the first light sources;

f) second LED sources of light; and g) an optics housing with a plurality of second round optics placed over the second sources of light;

wherein the cover has a backward member that precludes light generated from the first light sources and the second sources of light to mix inside of the housing.

12. The light fixture of claim 11, wherein the fixture has 50 to 150 optics, with each optic placed on top of the one or more of the first light sources.

13. The light fixture of claim 11, wherein the fixture has 4 to 8 rows of optics.

14. The light fixture of claim 11, wherein the optics housing is rectangularly shaped and has a plurality of openings for placing the second optics.

15. The light fixture of claim 11, wherein when illuminated, the lenses lack a dark spot as visible to the naked eye.

* * * * *